US005587100A

United States Patent [19]

Huang

[11] Patent Number: 5,587,100

[45] Date of Patent: Dec. 24, 1996

[54] PROCESS AND THE CONTRIVANCE EMPLOYED FOR PRODUCING HEAT ENERGY WITHOUT COMBUSTION

[76] Inventor: James P. S. Huang, No. 22-4, Lane 64, Sec. II, Chung Shen Road, Chung Ho city, Taipei, Taiwan

[21] Appl. No.: 614,912

[22] Filed: Mar. 13, 1996

Related U.S. Application Data

[63] Continuation of Ser. No. 237,281, May 3, 1994, abandoned.

[51] Int. Cl.[6] ..... H05B 6/46

[52] U.S. Cl. ..... 219/772; 219/687; 392/496

[58] Field of Search ..... 219/772, 628, 219/687, 688, 629, 759; 165/104.34; 392/496; 55/267

[56] References Cited

U.S. PATENT DOCUMENTS

| | | | |
|---|---|---|---|
| 2,979,311 | 4/1961 | Bungas | 392/496 |
| 3,445,616 | 5/1969 | Guyer | 219/628 |
| 4,062,348 | 12/1977 | Morrison | 126/270 |
| 4,747,447 | 5/1988 | Scanlan et al. | 165/104.34 |
| 4,967,052 | 10/1990 | Krapf | 219/688 |
| 5,059,866 | 10/1991 | Lo | 315/111.21 |
| 5,206,471 | 4/1993 | Smith | 219/687 |
| 5,353,369 | 10/1994 | Scarpa et al. | 392/496 |
| 5,397,401 | 3/1995 | Toma et al. | 136/259 |

*Primary Examiner*—Philip H. Leung
*Attorney, Agent, or Firm*—Michael N. Meller

[57] ABSTRACT

The present invention relates to a process for producing heat energy without combustion for causing no air pollution. More particularly, the present invention relates to a process which imposes kinetic energy selected from the group comprising static electricity, high voltage electricity and electromagnetic radiation upon selected matter to convert the electrons from such matter into an exciting or ionizing state, and collecting the heat energy released when the excited or ionized electrons from such matter go back to a lower energy state without combustion. The heat energy produced in accordance with the present invention does not go through combustion, therefore no pollution is created.

4 Claims, 4 Drawing Sheets

PROCESS AND THE CONTRIVANCE EMPLOYED FOR PRODUCING HEAT ENERGY WITHOUT COMBUSTION

This application is a continuation, of application Ser. No. 08/237,281, filed May 3, 1994, now abandoned.

FIELD OF THE INVENTION

This invention relates to a process and a contrivance for producing heat energy without combustion from the sources of kinetic energy comprising static electricity, high voltage electricity and electromagnetic radiation, through matter.

BACKGROUND OF THE INVENTION

Since ancient history, it has been recorded that humans generate heat by burning plant materials. This has been done for thousands of years. Recent history shows that we have substituted plant materials with coal, petroleum and natural gas, but we are still relying mostly on combustion for providing heat energy for industrialization and contemporary life.

However, in the past, people did not care about environmental pollution. Today, society demands that fuels must not only be inexpensive but should also cause minimal pollution.

Scientists have warned—"Do not burn anymore". For if we continue to burn for our energy like the present, the earth soon will not be a suitable place to live in.

They estimate that over 6,500,000,000 tons of $CO_2$ gas, is discharged into the atmosphere every year. In addition, to $CO_2$, the accompanied burning pollutants such as CO, $NO_x$, $H_2S$, hydrocarbons, ashes and residues do not count yet. Therefore, there is an urgent need to be able to produce heat energy without combustion for the sake of the world.

In the above situation, extensive and intensive studies on the process and contrivance for producing heat energy without combustion have been made by the joint efforts of various national and internatonal scientific groups. The inventors found that heat energy can be produced without combustion from the kinetic energy such as static electricity through matter.

SUMMARY OF THE INVENTION

One object of present invention is to provide a process for producing heat energy without combustion.

Another object of present invention is to provide a process for producing heat energy in which no matter is used up or destroyed by fire.

Yet another object of present invention is to provide a contrivance for producing heat energy without combustion.

DETAILED DESCRIPTION OF THE INVENTION

Figure 1:
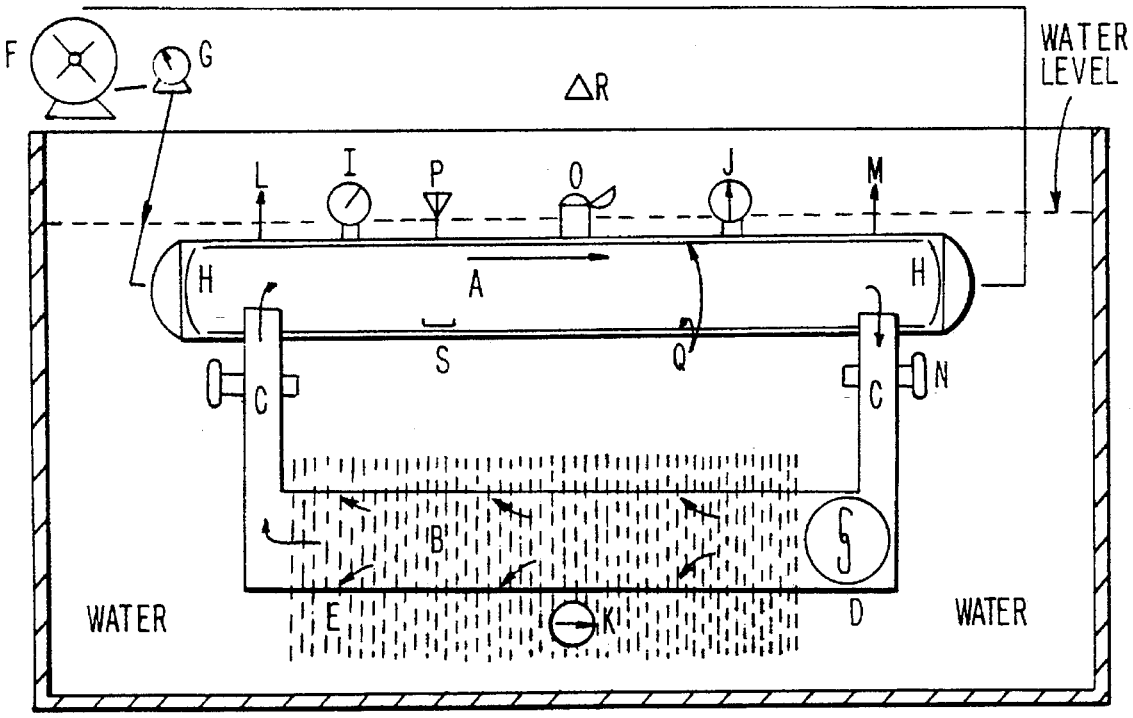
FIG. 1 is a front view of the contrivance of an embodiment of the present invention.

In the universe all matter is composed of atoms. According to Niels Bohr's atom model, nucleus are surrounded by electrons each of which is held in a certain definite stationary state (i.e. orbit) at which the force that attracts electron to the nucleus is balanced with centrifugal force. Any electron can be held in certain specific orbit which has specific radius around the nucleus. The higher the energy of electron has, the bigger the radius of orbit will hold the electron. The energy of electron is the sum of the kinetic and potential energies. Therefore, when electron is accelerated by outside influences such as heat, light (visible and invisible), rays (x-ray etc.), waves (microwave and electromagnetic etc.), the electron will be promoted to a orbit having a bigger radius, conversely, the electron will return to the original orbit after releasing a equivalent amount of energy which is given by the outside influences.

This is the key principle of this invention, to utilize static electricity to convert matter into an "energy conveyor" which can produce heat without combustion.

Further, we have found that any matter, whether solid or liquid, after being vaporized into a gas can be used as the "energy conveyor". But to vaporize matter would consume a lot of energy. So we prefer to use gaseous matter directly.

Since different matter has different number of electrons and electron configurations, they also possess different energy conveying powers. Amonst the gaseous matters as $F_2$, $Cl_2$, $I_2$, $Br_2$, $O_2$, $H_2$, $N_2$ and He etc., we have found $H_2$, He and $N_2$ are the best three matters to convey energy or be "energy conveyor". In addition $H_2$, He, $N_2$ are non-corrosive, non-toxic and readily available and also possess very high energy conveying powers.

There is an energy relationship between the static electron wave and the small particles, molecules of matters:

For example, Hydrogen $H_2$ is a fuel and a matter. It's heat of combustion is about 34,000 cal/g. and it has the highest heat content of all fuels. One gram of Hydrogen contains $6.02\times10^{23}$/mole divided by 2 of small particles.

To calculate the amount of heat contributed by each Hydrogen small particle:

34,000 cal divided by $3.01\times10^{23}=1.13\times10^{-19}$ cal/particle. Actually each Hydrogen small particle just contribute $1.13\times10^{-19}$ cal of energy.

$1.13\times10^{-19}$ cal of heat is: 0.00000000000000000113 of one calorie.

This tiny energy in comparison with the energy from atmospheric lightning (10–50 Mev) is very small.

But the energy of the lightning is also obtained by the gathering of mill ions upon mill ions of the electron's basic energy which is only (1 ev) $1.6\times10^{-19}$ joule or $0.384\times10^{-19}$ cal. (at 1 volt).

The energy of one small particle of Hydrogen ($1.13\times10^{-19}$ cal is actually three times bigger than the electron's basic energy o $0.384\times10^{-19}$ cal.

So 3 (ev) electron=one Hydrogen small particle's energy.

But the electron's (ev) energy can be stepped up easily to a very high level.

FIG. 1 shows the contrivance of present invention in which (A) represents a cylindrical shape copper reactor (ϕ=12 cm, L=185 cm), (B) represents a special alloyed heat releasing reactor (ϕ=12 cm, L=185 cm), (C) represents passage tubes connecting (A) and (B), (D) represents gas circulating machine, (E) represents aluminum heat diffuser, (F) represents electrostatic wave generator (G) represents electrostatic wave regulator (H) represents electrodes (I) represents thermometer (J) represents vacuum meter (K) represents high temperature gauge (L) represents gas inlet valve (M) represents gas evacuating valve (N) represents connecting tube valve (O) represents glass viewer window (P) represents mercury inlet valve and bottle (Q) represents glass reflecting lining (R) represents spectrophotometer and recorder (S) represents mercury evaporator. Basically the process of present invention, is to convert the kinetic energy of static electricity into heat.

Firstly: To impose extra energy on selected matter (extra energy can be static electricity, light, microwave, high voltage Ac or DC currents etc., but, we prefer to utilize the abundant static electricity).

Secondly: As soon as the matter has absorbed a certain amount of kinetic energy of the static electricity, this matter then converts itself into an "energy conveyor". The amount of the absorbed energy is closely related to the existing internal potential energies of the selected matter, such as chemical bond energy, molecular bond energy, atomic ionization energy and atomic energy levels etc.

Thirdly: The "energy conveyor" changes the kinetic energy of the static electricity internally into heat energy without combustion.

Fourthly: As soon as the "energy conveyor" releases its heat, it converts back to the original state of the selected matter again and the amount of the energy released is in proportional to the energy absorbed.

Fifthly: As soon as the "energy conveyor" converts itself back to the original state of the selected matter, another cycle can begin again. And this completes a total energy reversible cycle, but all without combustion. While the present invention is described in detail by illustration of examples in the following, the present invention is not limited to these examples.

EXAMPLE 1

This example (1) shows how to produce heat energy without combustion in our contrivance.

Take hydrogen gas $H_2$ as an example, hydrogen is a fuel and a matter too. It has the highest heat of combustion among fuels, 34,000 cal/g. However, we do not use Hydrogen's combustion energy. Hydrogen atom is the simplest element, with only one electron.

Figure 2:
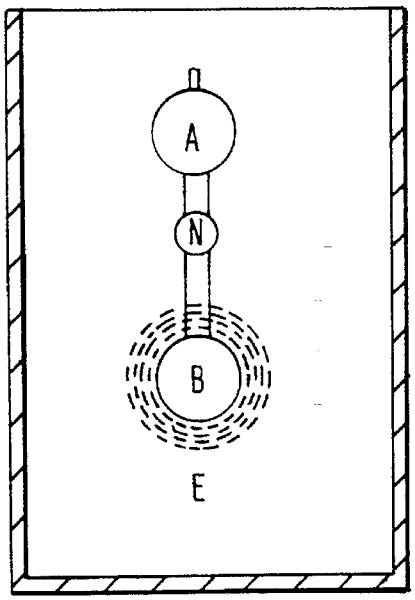
FIG. 2 is a side elevation view of the contrivance of an embodiment of the present invention.
Figure 3:
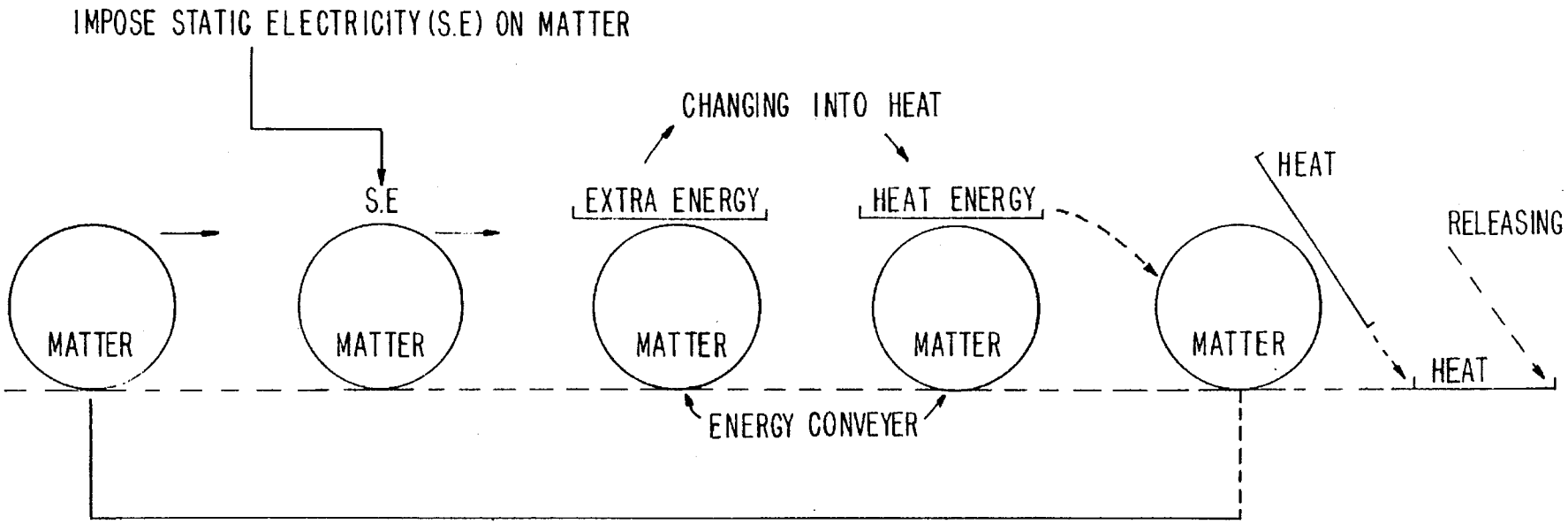
FIG. 3 is a schematic diagram illustrating how the material used in the present invention conveys and releases energy.

Contrivance operation procedure: With reference to the drawing. (FIGS. 1 & 2)

(1) To use a vacuum pump to pump out the air in (A) & (B) reactors from (M) valve. Then flush (A) & (B) reactors with Nitrogen, $N_2$ gas and again pump the nitrogen gas out to make (A) & (B) in vacuum again. Vacuum pressure is showned on (J) vacuum meter.

(2) To fill some mercury or equivalent into (A) reactor through (P) valve from upper air tight bottle. It is important that air not enter the bottle. A substitute can be used in place of mercury.

(3) To fill 11 liters of Hydrogen gas, $H_2$ into the vacuumed (A) & (B) reactors (4) To start (F) static electron wave generator and it's (ev) can be adjusted by (G) regulator.

(5) From (O) inspection view window we can see violet ray emissions that will indicate the process is being in the proper reacting condition. The energy of the light wave (hv) and the kinetic enery of electron (ev) had imposed the "extra energy" on Hydrogen and the hydrogen had already became the "energy conveyor", and the spectrophoto meter will have recorded the above phenomena.

(6) Then the (D) gas circulating machine let the $H_2$ gas "energy conveyor" in (A) go through the right side tube (C), then entered into (B) special alloyed heat releasing reactor. Where the "extra energy" on the "energy conveyor" changes into heat energy. and is conducted through the wall of (B) reactor to the outside heat diffuser to water.

The Hydrogen "energy conveyor" after setting free it's heat energy, is converted back to ordinary Hydrogen again and circulating through the left side connecting tube (C) back to (A) reactor making a complete cycle.

The Hydrogen "energy conveyor"'s released heat is very high in temperature. So the whole contrivance except (F) & (G) should be submerged in water to avoid melting.

Figure 4:
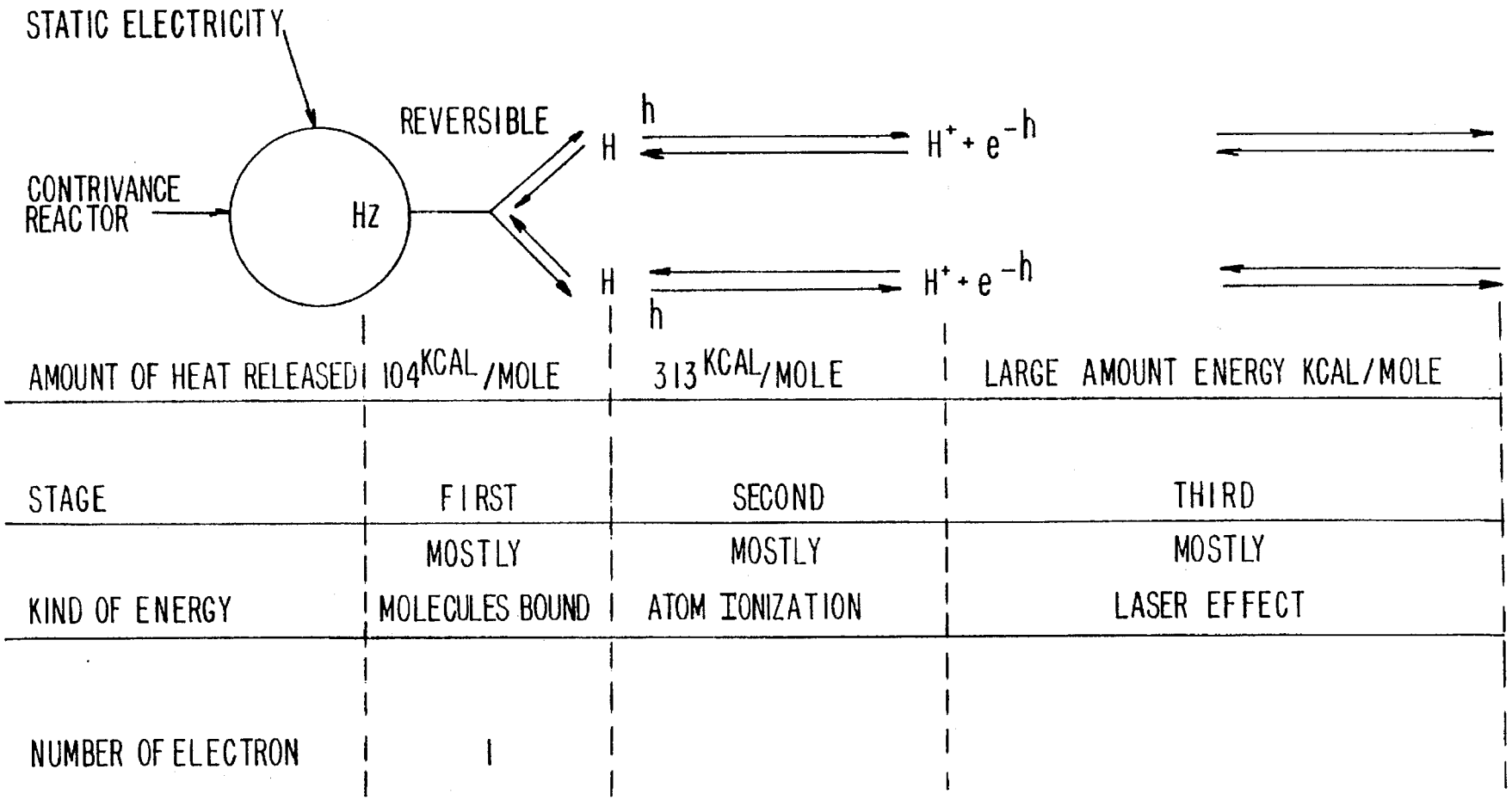
FIG. 4 is a schematic diagram illustrating various amounts of heat energies released through $H_2$ inside the contrivance of Example 1 of the present invention.
Figure 5:
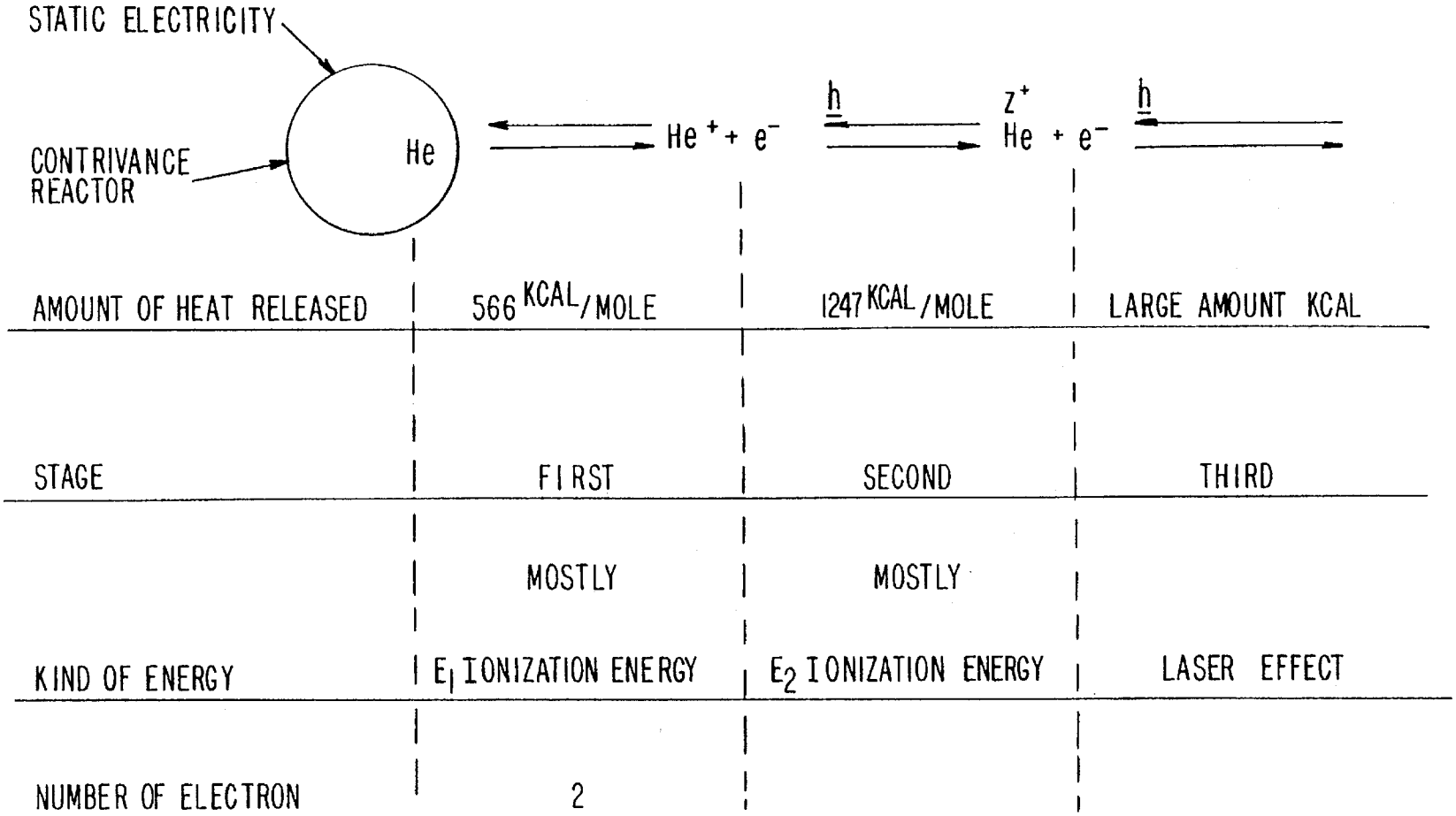
FIG. 5 is a schematic diagram illustrating various amounts of heat energies released through He as non-fuel matter inside the contrivance of the embodiment of Example 2 of the present invention.

The heat released by the Hydrogen "energy conveyor" is much higher than the heat of the combustion of Hydrogen (which is 34,000 cal/g). The heat rating of "energy conveyor" is from 52,000 cal/g. to 208,000 cal/g. & even higher. Because it is the sum total of the energy of chemical bond energy plus atom and molecule bond energy plus atom ionization energy plus laser effect energy plus others etc. (see FIG. 4).

EXAMPLE 2

This example 2 shows how to produce heat energy without combustion from static electricity through a non-fuel matter.

A (gaseous) non-fuel matter can also be transformed into the "energy conveyor" and become an energy releaser.

Take Helium for example. Helium (He) is a non-fuel matter. Therefore it is non-ignitable and non-flammable and Helium does not have any "heat of combustion".

But by the use of my invention's method, can also be changed into a "energy conveyor" and able to release heat.

Using the same contrivance as in example 1:

Prepare 11 liters of Helium (He).

To empty the contrivance and to fill it with 11 liters of Helium (He) gas into (a) and (B) reactors. The necessary steps and procedures are the same as in example 1. But the minimum acceptable static electricity (ev) to convert helium into the "energy conveyor" is about 24.6 ev and the maximum acceptable (ev) is about 55 ev.

At 24.6 (ev) Helium "energy conveyor" can release heat energy of 140,000 Cal/g.

At 55 (ev) helium "energy conveyor" can release heat energy of 312,000 cal/g.

Different conveyor matter releases different amounts of energy. It hower requires different amounts of imposed energy.

It is not just any amount of extra "extra energy" can be imposed upon the "energy conveyor". It depends upon the accessibility or acceptability of the different matters used. It also relates to the energy level, molecule bond energy, chemical bond energy, ionization energy and the electron arrangement of the different matter.

For instance, the maximum acceptable working "extra energy" load on Hydrogen is about 14 (ev), beyond that range it wasteful.

But the maximum acceptable working (ev) load on Helium is about 54–55 (ev). That means "Helium conveyor" at that stage can convey more "extra energy" than the Hydrogen conveyor does. In other word, the Helium "energy conveyor" at that stage can release more heat energy than the Hydrogen "energy conveyor".

The function inside the contrivance is very complicate but is simple in operation.

The total energy produced from the contrivance is the sum of a complex atomic energies of non-radioactive matter, involving the energies of:

$$\frac{\text{Chemical bond energy Molecule bond energy Atom ionization energy + Laser effect energy etc.}}{\text{Amount of heat produced from the contrivance}}$$

In our contrivance there is a 3-stage (low, medium, high) heat regulator switch based on the above principle.

The function of contrivance of example 1

(1) The electrostaticwwave in (A) reactor ionized the mercury vapor and produced mercury arc of $\lambda$=2537 A (2) The mercury arc and Hydrogen molecules in (A) reactor produces resonance radiation.

(3) The electron waves, radiation waves and light waves (Hv) impose their "extra energy" on the Hydrogen small particles and changes Hydrogen into "energy conveyor".

(4) The Hydrogen "energy conveyor" in (A) reactor by the aid of (D) gas circulating machine, circulated through the right side tube (C) into (B) reactor, then set free the imposed "extra energy" and converting it into heat energy. The heat conducted through (B) reactor wall to the outside diffuser then to water.

(5) The Hydrogen "energy conveyor" after releasing it's heat energy becomes ordinary Hydrogen again and circulating back into (A) reactor ready to start another cycle.

The advantages of present invention include:

(1) Heat Energy can be produced without combustion.

(2) To produce Non-polluting Heat Energy without harmful by products, carbon dioxide exhaust gas, acid rain, ashes etc.

(3) To change matters into "energy conveyor" and then releasing heat without combustion, the matter can be used over again.

(4) By the present invention's method 1 g of Hydrogen can produce Heat 52000 cal–208000 cal (much higher than the heat of combustion of $H_2$)

(5) By the present invention's method Non-Fuel matter can also be changed into the "energy conveyor" and then releasing heat as an energy releasor.

(6) To change the static electricity into heat energy directly.

(7) Heat produced from the present contrivance is a kind of complex atomic energy and is very high in temperature.

What is claimed is:

1. A process for producing heat energy without combustion comprising:

a) using a vacuum pump to evacuate air from a cylindrical shaped reactor including an electrostatic wave generator and a heat releasing reactor which interconnect to said cylindrical shaped reactor through a gas circulating device;

b) flushing said cylindrical shape reactor and heat releasing reactor with nitrogen gas;

c) filling said cylindrical shaped reactor and heat releasing reactor with a predetermined amount of gaseous matter selected from the group consisting of nitrogen, helium and hydrogen;

d) turning on said electrostatic wave generator to produce static electricity at an energy level sufficient to energize the gaseous matter with kinetic energy of static electricity;

e) introducing the gaseous matter energized by said kinetic energy of static electricity into said heat releasing reactor through said gas circulating device for converting said kinetic energy to heat energy;

f) releasing said heat energy from said heat releasing reactor while restoring the energized gaseous matter to an unenergized state; and g) returning the restored gaseous matter to said cylindrical shape reactor to start another cycle.

2. The process of claim 1, wherein the heat energy is converted using 4.5 ev to 14 ev kinetic energy of static electricity to directly set free the molecular bond heat energy from the gaseous matter.

3. The process of claim 1, wherein the heat energy is converted using 14 ev to 24 ev kinetic energy of static electricity to directly set free the atomic ionization heat energy from the gaseous matter.

4. The process of claim 1, wherein the heat energy is converted using 24 ev to 55 ev kinetic energy of static electricity to directly result in laser intensive heat energy from the gaseous matter.

* * * * *